US005566530A

United States Patent [19]

Johnstone et al.

[11] Patent Number: 5,566,530

[45] Date of Patent: Oct. 22, 1996

[54] PACKAGING SYSTEM

[76] Inventors: Peter Johnstone; Gary Emmerton, both of C/o. 34-36 Lakeside Avenue., Reservoir, Victoria 3073, Australia; Paul J. Fitzpatrick, 18 Enderley venue, Hamilton, New Zealand; Perehama Hanara, 19 St. Winifreds Avenue, Hamilton, New Zealand; Lindsay G. Wyborn, 73 Nevada Road, Hamilton, New Zealand

[21] Appl. No.: 288,962

[22] Filed: Aug. 10, 1994

Related U.S. Application Data

[63] Continuation of Ser. No. 983,560, filed as PCT/AU91/00350, Aug. 8, 1996 published as WO92/02415, Feb. 20, 1992, abandoned.

[30] Foreign Application Priority Data

| | | | |
|---|---|---|---|
| Aug. 9, 1990 | [AU] | Australia | PK1658 |
| Jul. 11, 1991 | [AU] | Australia | PK7175 |

[51] Int. Cl.[6] ..... B65B 43/08; B65B 53/00

[52] U.S. Cl. ..... 53/441; 53/456; 53/556; 53/575; 206/597

[58] Field of Search ..... 53/399, 441, 447, 53/556, 575, 587, 588, 540, 456, 577, 452, 574, 563; 206/597, 45.33, 432, 497

[56] References Cited

U.S. PATENT DOCUMENTS

| | | | |
|---|---|---|---|
| 3,087,610 | 4/1963 | Kirkpatrick | 206/432 |
| 3,479,930 | 11/1969 | Peppler | 53/575 |
| 4,129,467 | 12/1978 | Knutsson | 53/456 |
| 4,309,861 | 1/1982 | Karpisek . | |
| 4,500,001 | 2/1985 | Daniels | 53/399 X |
| 4,546,593 | 10/1985 | Lasscock | 53/447 X |
| 4,607,476 | 8/1986 | Fulton | 53/587 X |
| 4,658,570 | 4/1987 | Thomas | 53/588 X |
| 4,662,151 | 5/1987 | Mathes et al. | 53/587 |
| 4,845,927 | 7/1989 | Rapparini | 53/575 X |
| 4,924,654 | 5/1990 | Langen et al. | 53/456 X |
| 4,949,533 | 8/1990 | Bate | 53/588 X |

FOREIGN PATENT DOCUMENTS

| | | | |
|---|---|---|---|
| 1072783 | 8/1983 | Australia . | |
| 8606345 | 11/1986 | European Pat. Off. . | |
| 190457 | 7/1957 | Germany | 53/587 |

*Primary Examiner*—Linda Johnson
*Attorney, Agent, or Firm*—Bell, Seltzer, Park & Gibson, P.A.

[57] ABSTRACT

An apparatus for palletizing and wrapping a load of material which may be irregularly shaped solid articles; liquid or flowable granules comprising a support base and an open upstanding framework adapted to form a volume to be at least partially filled with articles, wherein said framework provides a formwork for plastic film wrapped there around at least on its vertical periphery.

11 Claims, 10 Drawing Sheets

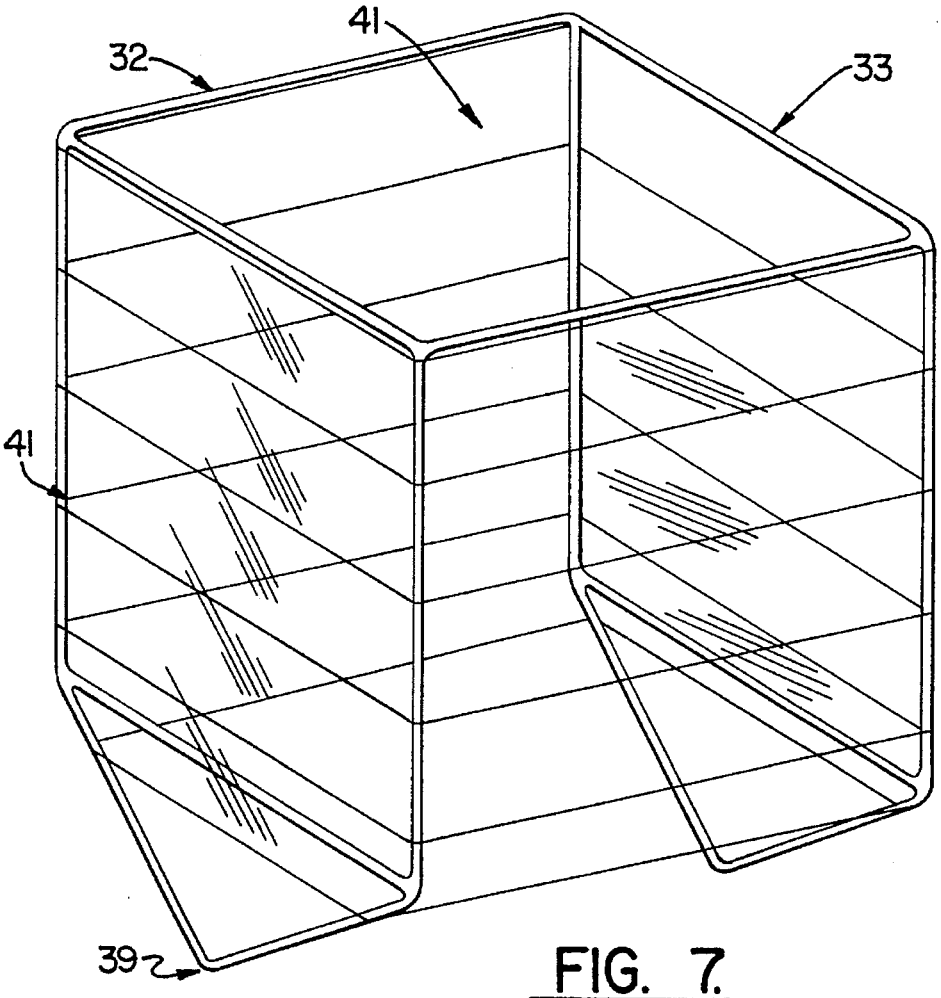
FIG. 7.
FIG. 8.
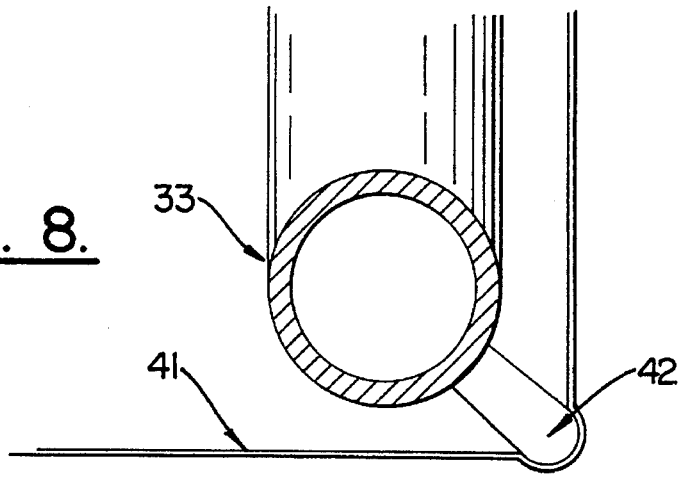

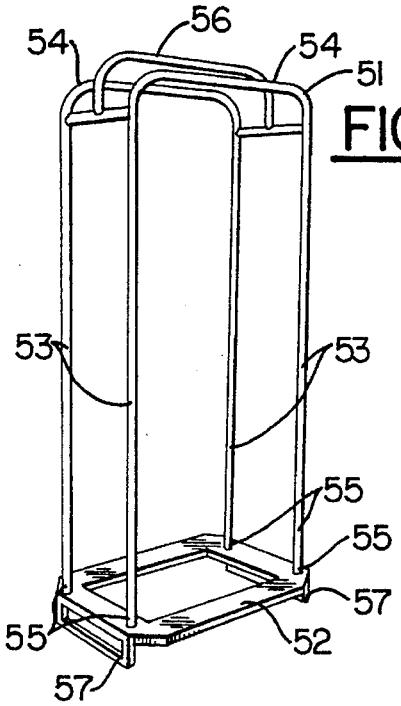
FIG. 10.
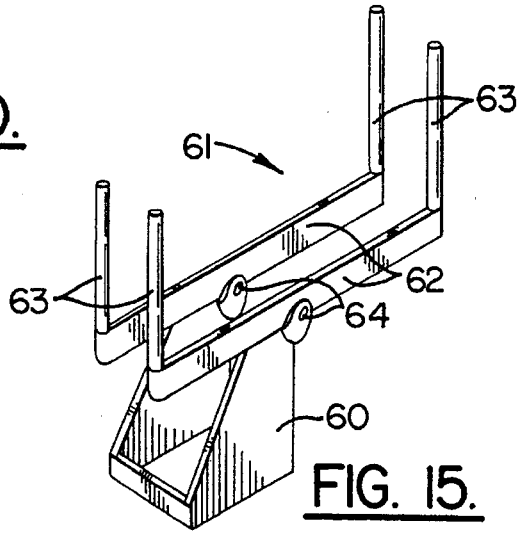
FIG. 15.
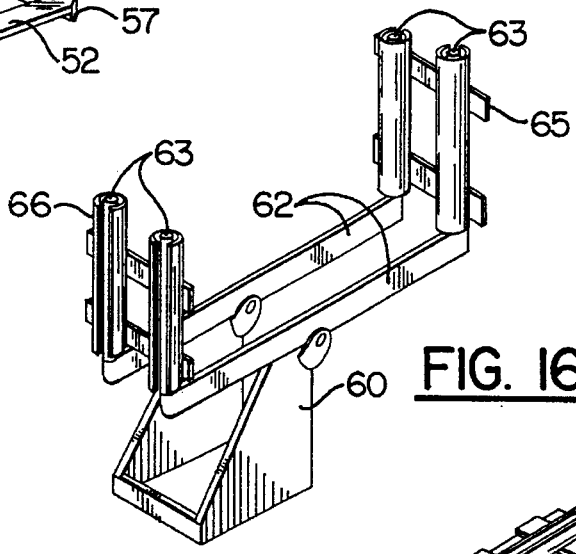
FIG. 16.
FIG. 17.
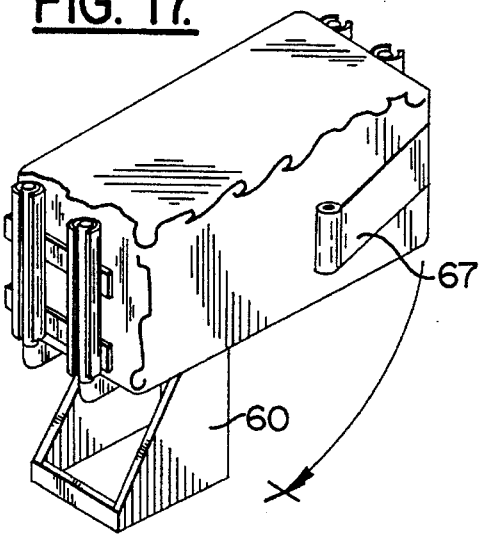
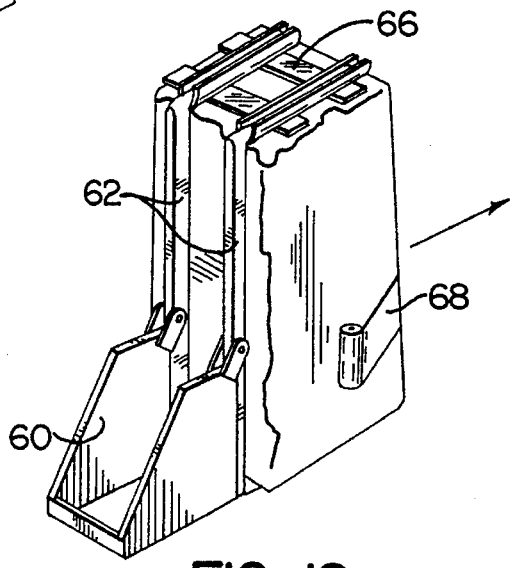
FIG. 18.

PACKAGING SYSTEM

This is a continuation of application Ser. No. 07/983,560, filed as PCT/AU91/00350 on Aug. 8, 1991 and published as WO92/02415 on Feb. 20, 1992, and now abandoned.

BACKGROUND OF THE INVENTION

The invention relates to the packaging of articles, particularly irregularly shaped articles flowable granules or liquids, and in particular but not exclusively frozen carcass meat intended for shipping overseas. The method or methods of the invention may be incorporated into fully automated packing lines.

Currently the shipping of irregularly shaped articles, such as frozen carcasses, creates problems in the efficient utilization of space in shipping containers. Currently there is an excessive amount of manual handling required during loading and unloading procedures, particularly during unloading from storage containers at a destination. The articles are stored in containers in loose condition and therefore must be manually removed from the container.

Containerized transport of meat carcasses usually requires special cellular container ships to be used and excludes non-container vessels from carrying meat for export. Also, as container vessels can only be loaded or unloaded at ports with special container terminals and facilities, containerized meat cannot be exported from smaller non-container ports. This may increase transport costs where the meat processing plant is located distant from a container port and the containers must be transported by rail or road to the port. Another disadvantage with containerized transport of meat carcasses is that the loading and unloading of the carcasses individually into the containers is labor intensive.

The invention is also useful in the packaging of flowable granules such as plastic granules, cereals or liquids as well as for baling of waste materials with only minor modification to the construction of the system being required.

Materials of all kinds including industrial commercial and domestic waste materials are currently handled in a variety of ways including bags which are relatively expensive if they are to be subject to exposure to liquids and/or compacting of the contents. This is also the case in relation to Intermediate Bulk Containers (IBCs).

This also applies to flowable granule like materials such as plastic, cereals or fertilizer which are normally packed in IBCs.

It is one object of the invention to reduce packaging costs in such a situation.

The present invention has as a principal objective the provision of a method and apparatus for unitizing and packaging or palletizing and packaging articles, particularly irregularly shaped articles, such as frozen animal carcasses, for shipment whereby wastage of space and excessive handling time is minimized and the proven load handling advantages of palletization can be fully realized.

SUMMARY OF THE INVENTION

There is provided according to the present invention a method of palletizing irregularly shaped articles, such as frozen animal carcasses, comprises the steps of:

(i) positioning an upstanding movable open framework in association with a pallet to form a structure with the pallet forming the base thereof and the framework being mounted at or near the peripheral region of the pallet to form an accessible space bounded by the pallet and the open framework;

(ii) stacking the articles on to the pallet into the accessible space within the volume bounded by the structure to at least partially fill said accessible space;

(iii) wrapping with stretchable plastic film at least the upstanding portion of the structure and moving the framework from the wrapped structure after the wrapping step, leaving the loaded volume as a single discrete wrapped package supported on the pallet base.

There is also provided a packaging system for flowable materials such as granules or liquids comprising the steps of bringing a base member and a releaseable upstanding frame member together wrapping said frame member and at least part of the base member to form an open accessible volume closed at the side and bottom at least partially filling the volume with flowable material and subsequently removing said releasable frame.

There is also provided a method of palletising irregularly shaped articles comprising the steps of bringing a pallet and upstanding frame member into close association to form an open accessible volume, at least partially filling said articles into said volume so that the articles are supported on the pallet and by said frame members within said volume, wrapping said loaded volume and frame members with plastic film to at least partially enclose said loaded volume and frame members and subsequently retracting or removing said frame members. A suitable adhesive may be used to adhere the base to the wrapping.

There is also provided a method of forming a wrapped, unitized pack of liquid or solid materials comprising an open frame defining a hollow space and applying stretch plastic wrapping film around the open frame to form a container open at one end, said formed container being arranged to be at least partially filled with said material wherein the frame is separable and removable from the wrapping film to allow closing of the container and its contents. There is also provided by the invention a wrapped unitized pack of liquid or solid material container comprising an open frame defining a hollow space and stretch plastic wrapping film wrapped around said frame to form said container pack open at one end, said container being arranged to be at least partially filled with said material wherein the frame is separable and removable from the container to allow closing of the container and its contents.

Conveniently the frame members are so arranged as to be removable after said wrapping step without disturbing said wrapped articles. Alternatively, the frame members are of telescopic construction enabling them to be retracted after use. Preferably the frame members are retracted into the supporting framework for the pallet base after the wrapping step.

There is also provided according to the present invention apparatus for palletising and wrapping a load of articles comprising a support base and an open upstanding framework adapted to form a non-enclosed volume to be at least partially filled with articles, wherein said framework provides a formwork for plastic film wrapped therearound at least on its vertical periphery.

In one aspect of the invention the open frame includes a substantially rigid top and sides formed of frame members which are able to flex towards each other. Stretch plastic film is wrapped around the frame to form a wall supported by the frame members, the wall being closed at the bottom to form an open topped container. The stretch film may have a stretch applied thereto of between 10% and 400% dependent upon the type of stretch film used, resulting in substantial tension in the film over the frame. This tension causes the frame members of the sides to flex towards each other and once the container has been formed with the stretch film material to fill the container is loaded into the form container and if desired may be compacted therein. Once the container is full, a lifting force may be applied to the top of the frame which causes the frame to disengage from the container. This disengagement may be assisted by inward flexing of the side frame members.

As the container disengages from the open frame the tension remaining in the stretch plastic film tightly holds the material In the container in a compacted bale. The upper edges of the container wall contract around the top of the material to firmly hold that in place. Additional stretch plastic material can be applied across the top of the bale if necessary to prevent spillage of material therefrom and to increase the strength of the container.

The stretch film may be applied to the support frame using a known wrapping machine having a rotatable platform on which the frame is securedly held either in a normal or an inverted position. The film is applied to the frame from a roll mounted on the machine, the roll having braking means associated therewith so that the film is stretched between the roll and the frame while the frame is rotated.

Conveniently the framework is removable after said wrapping is completed.

Conveniently the base supports a pallet within the volume defined by the upstanding framework.

Preferably the film wrapping is carried by spiral wrapping or a combination of spiral wrapping and parallel wrapping. The width of the parallel wrapping may be relatively wide say of 1 to 2.5 meter while the spiral wrap may be of ⅓ to ½ meter.

The present invention provides an improved method and apparatus for packing meat carcasses enabling the transport of meat carcasses by non-container or dual-function ships.

It is envisaged that each complete pack weighs in the range of 0.3 to 2.0 tons and preferably about 0.7 to 1.2 tons.

It will be appreciated the invention has application to packaging of various types of irregularly shaped articles such as half carcasses or parts of carcasses such as joints or meat packs and other article types such as pipes or rods, etc.

BRIEF DESCRIPTION OF THE DRAWINGS

The invention will be described in greater detail when having reference to the accompanying sketches in which:

FIG. 7 shows the frame of FIG. 6 having stretch plastic film wrapped therearound to form an open-topped container;

FIG. 8 is a detail view showing one form of frame member;

FIG. 10 shows a first preferred form of frame forming a temporary physical support means, when empty;

FIG. 15 shows a second preferred form of frame forming a temporary physical support means;

FIGS. 16 to 18 sequentially show the wrapping and removal of a stack of carcasses on the frame of FIG. 15;

DETAILED DESCRIPTION OF THE INVENTION

Figure 1:
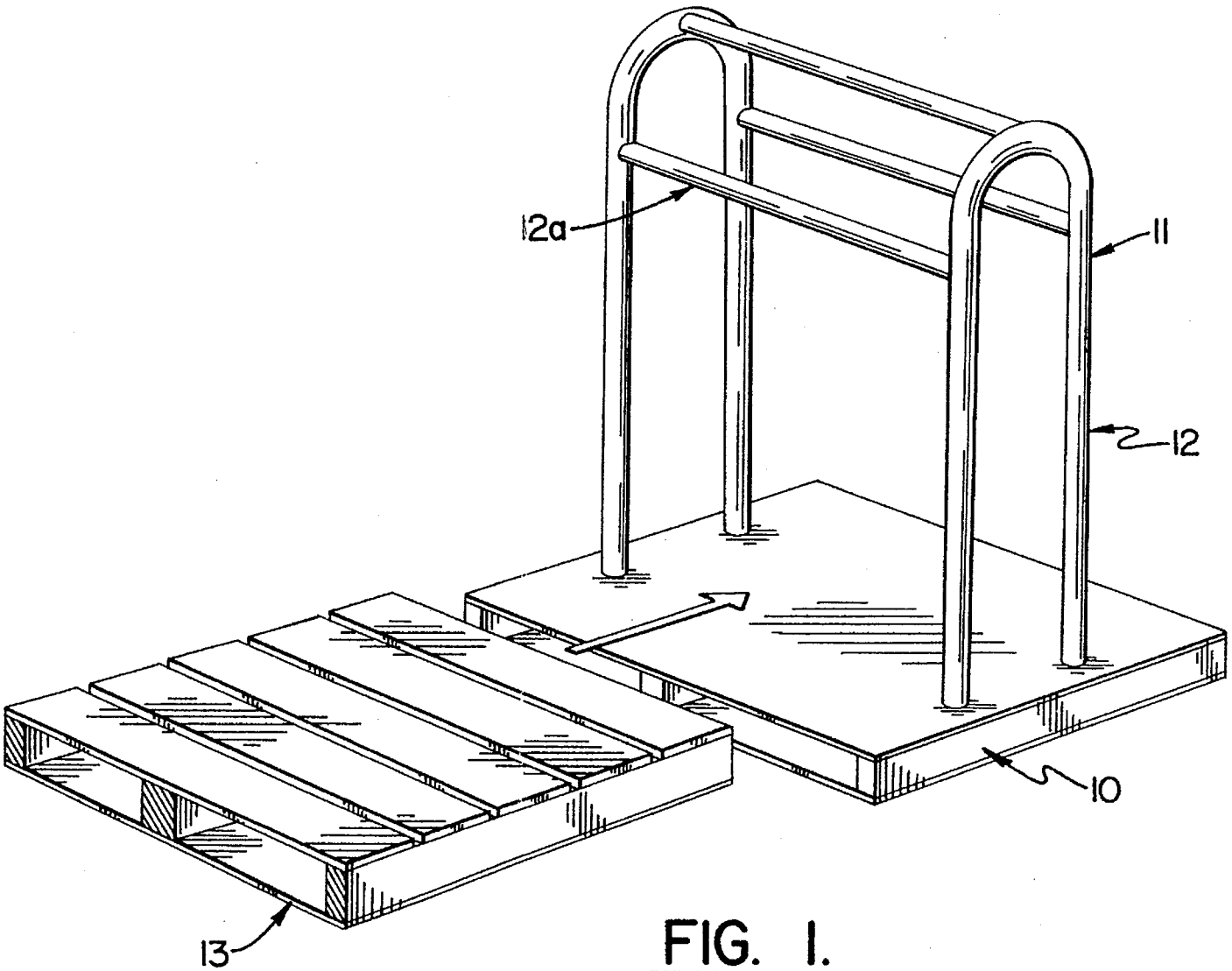
FIG. 1 is an exploded view of palletizing apparatus.
Figure 2:
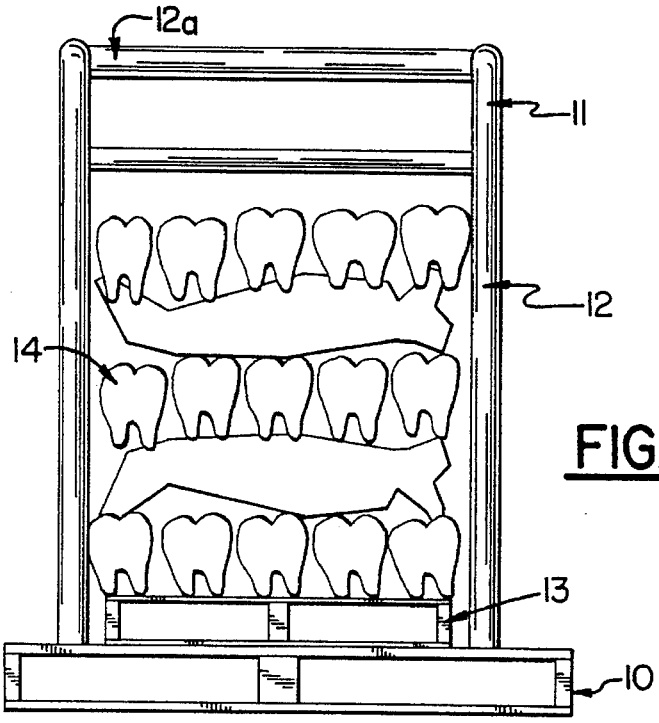
FIG. 2 is an assembled view of the loaded palletizing apparatus.

The invention has been described with specific reference to the packaging and palletising of frozen meat carcasses however it will be appreciated that the invention is applicable to the storage and packing of any articles particularly irregularly shaped articles.

With reference to the Figures the apparatus of the present invention embodies a framework base 10 and open framework 11 releasably secured to the framework base. The framework base may itself be in the form of a pallet for convenient handling by a forklift vehicle.

The size and dimension of the framework base 10 and the spacing betwen the upstanding uprights 12 of the open framework is such as to accommodate a standard sized pallet 13 as shown on the framework base 10 within the confines of the open framework uprights 11.

Figure 3:
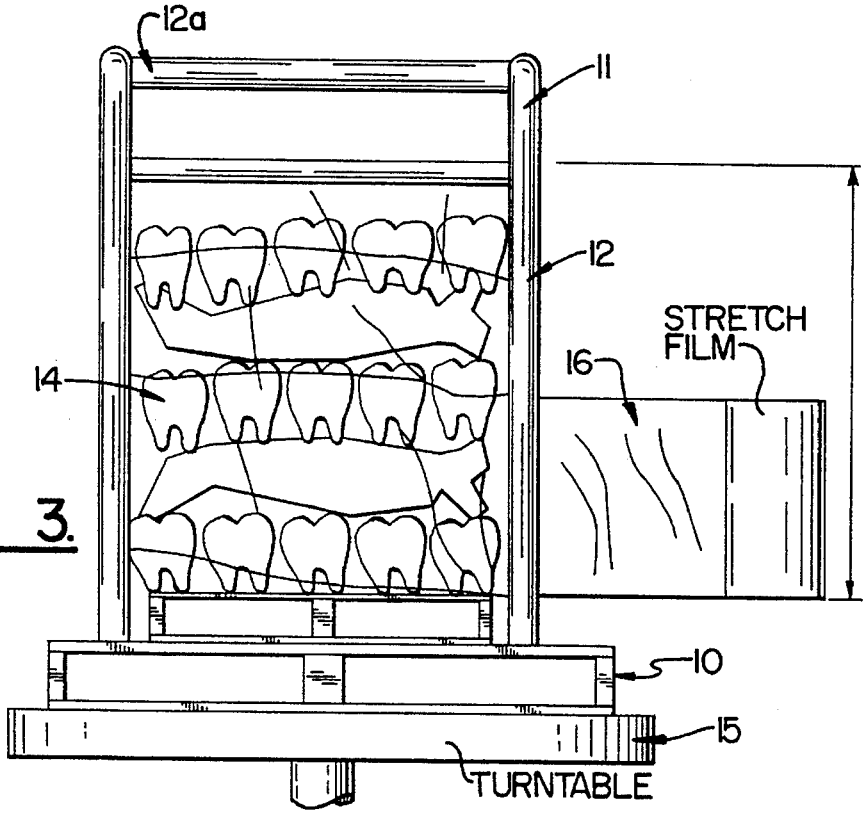
FIG. 3 is a view showing the wrapping step.
Figure 4:
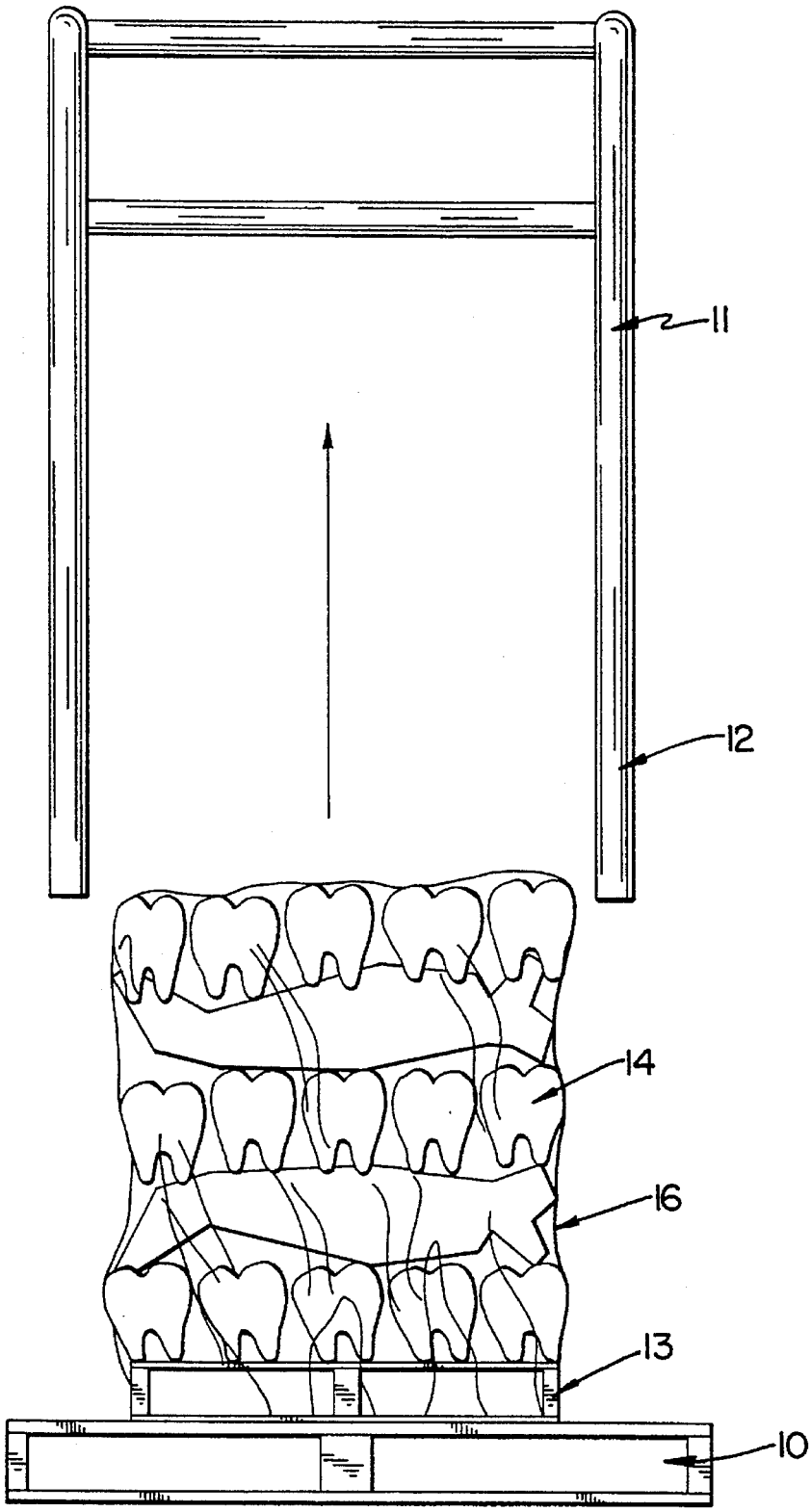
FIG. 4 shows the final package after removal of the open frame.

Upon assembly of the pallet 13 onto the frame base 10 and the upstanding framework 11 irregularly shaped articles such as frozen lamb carcasses 14 or the like as shown may be stacked onto the pallet within the confines of the upstanding framework. Once filled the frame base 10 is rotated by a suitable means such as a turntable 15 as shown in FIG. 3 and during the turning operation stretch film 16 which is commercially available particularly self adhesive stretch film may be applied to the loaded upstanding framework volume as shown in FIG. 3. In this way a tight wrapping of the load is achieved over the vertical distance of the loaded articles. Subsequent to this wrapping step the open framework may be simply removed by lifting from the loaded structure as shown in FIG. 4 leaving the articles mounted in tightly wrapped formation on the pallet. The loaded pallet can then be easily maneuvered by the use of a conventional forklift truck for loading into storage containers for shipment. Preferably the vertical sides of the loaded pallet only are wrapped however if desired the entire load may be wrapped along the horizontal surfaces to more completely wrap the load.

It will be appreciated that the storage and transport of irregularly shaped articles such as beef and sheep carcasses in full or part portions is simply achieved by the invention. When the upstanding framework members are removed from the support frame base the carcasses are left tightly wrapped in the plastic. Any slack left by the removal of the open framework is easily taken up by the resilience of the stretch film which will tighten around the load after the frame has been removed.

Whilst the invention is in one form adapted for use in storage and transport of frozen carcasses, which are by nature irregularly shaped, it will be appreciated that the apparatus and method is applicable to shift goods and articles including packaged goods and fresh produce of all kinds that requires unitization for storage and transport. Furthermore the invention is applicable for overseas transportation of goods as well as in short distance and storage applications. The wrapping procedure as devised in reference to FIG. 3 using a turntable may be varied as described. For example, wrapping may be carried out by a rotating or swinging arm (not shown) upon which is mounted the reel of stretch film to effectively wrap the stacked articles as described. Of course it may be intended to simply carry out the wrapping manually where small job lots are involved.

With reference to FIG. 4 it is envisioned that the construction of the open framework 11 be modified to allow the wrapped pallet load to be simply lifted from the frame base clear of the framework as an alternative to the lifting of the framework clear of the load. In this construction four or more upstanding poles without cross members 12*a* would achieve the support for the articles.

Figure 5:
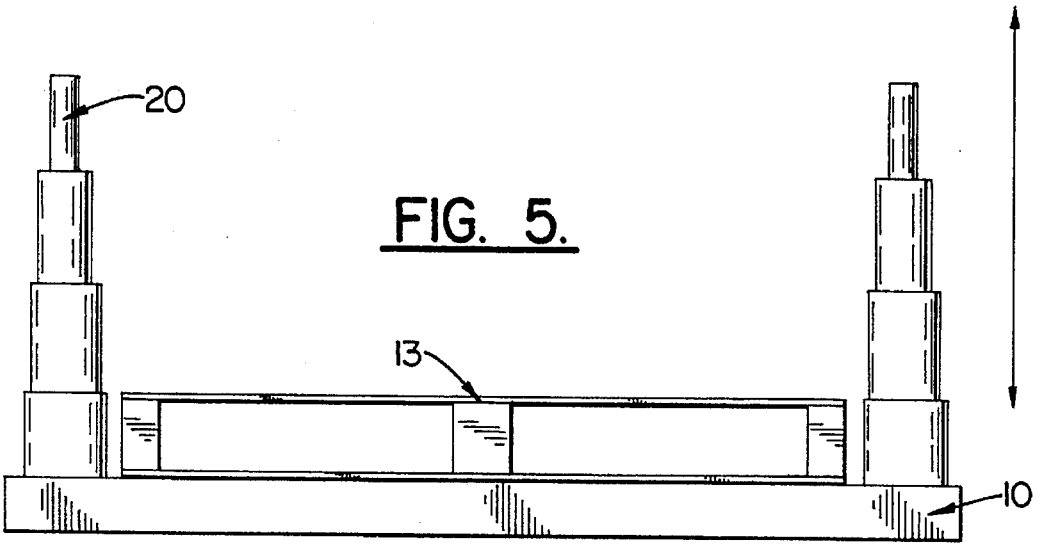
FIG. 5 is an alternative embodiment of the invention showing an open frame with telescopic legs.

With reference to FIG. 5 the poles 20 forming the open framework are of telescopic construction having their base in the framework base 10. In the projected position the poles form an accessible space into which irregularly shaped articles may be loaded and stacked and after the wrapping step shown in FIG. 3 the poles are retracted into the framework base to an out of the way position whereby the loaded pallet 13 can be removed for stacking in a cargo hold or the like.

Figure 6:
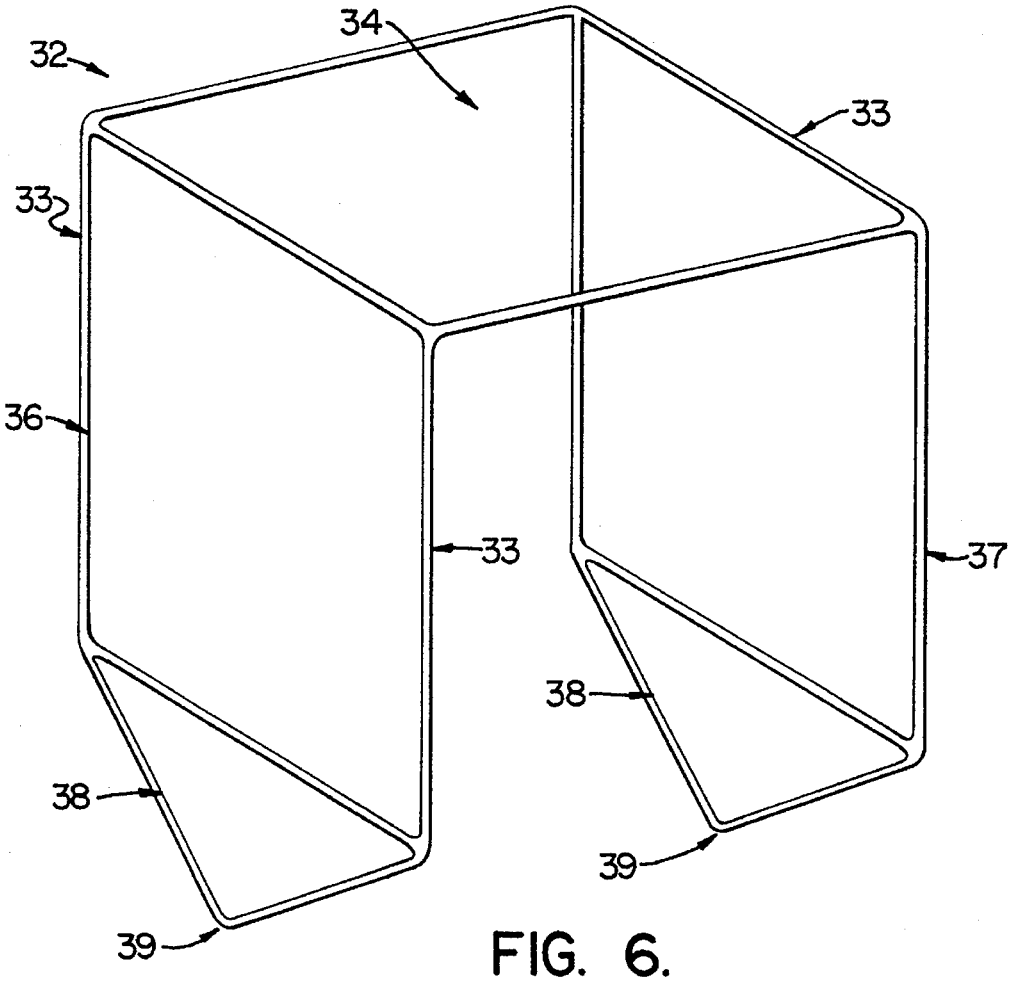
FIG. 6 shows a frame of an embodiment of the present invention.

Referring to the drawings, in FIGS. 6 and 7 there is illustrated a simple form of the present invention in which the support frame 32 is formed of welded tube members 33 to define an open top 34 and two spaced, depending side frame sections 36 and 37.

The bottoms 38 of the frame sections 36 and 37 are of triangular shape with the apex 39 thereof lowermost. this shape facilitates the wrapping of stretch film about the base of the frame to form a closed container.

As shown in FIG. 7, stretch plastic wrapping film 41 is wrapped about the tube members 33. The stretch plastic film has a stretch applied thereto of between 10 and 400% so that the film is under tension between the frame members 33. The film has a width such that a number of circumferential passes needs to be made in order to form the container with several plies of overlapping film.

Because of the tension in the stretch film when applied to the support frame 32, the side frame section 36 and 37 flex inwardly towards each other. This facilitates subsequent removal of the film container from the support frame 32 when the container is filled with material to be packed.

That material may be compacted into the support frame 32, as would be the case with say waste material. For this purpose, the support frame 32 may be held by a secondary frame or support to hold the support frame 32 with the open top 14 uppermost. Compaction may take place using an appropriate compacting weight lowered into the support frame 32, or by using any other suitable compaction means. If desired, an appropriate compaction machine could be provided in which the support frame is mounted after being wrapped with the stretch plastic wrapping film.

Once the container formed by the stretch film has been sufficiently filled, the container is removed from the support frame 32 by applying appropriate forces between the frame and the material within the container whereby, due to the tapering nature of the flexed side frame sections 36 and 37, the container slides easily from the tube members 33.

Referring to FIG. 8, to reduce the frictional contact between the stretch film wrapped around the tube members 3, the tube members 33 may be provided with longitudinally extending ribs 42 which space the stretch film 41 from the tube members 33 and provides a relatively small area of contact thus reducing the friction and making it easier for the filled container to slide from the tube members 33. It will be appreciated that the tube members 33 may be formed of any suitable shape or have any suitable rib or the like attached or formed integral therewith in order to provide minimal surface contact between the stretch film and the support frame members. Alternatively, the tube members 33 may be provided with rollers, endless belts or other means for facilitating the removal of a filled container from the support frame 32.

The stretch film wrapping preferably extends around the frame to a distance of up to about 1 meter above the proposed filling height of the container leaving several upper layers of film above the height of the filling material.

Once the filled container is removed from the support frame 32, the upper layers of stretch film 41 contract around the upper edges of the material within the container. These upper edges can then be gathered and tied or sealed to form a closure for the top of the container. Alternatively, stretch film may be applied thereto to prevent spillage of material from the container, or prior to removal of the container from the frame a top sheet may be placed over the surface of the filling material to provide a cover prior to tying or sealing. Alternatively, prior to removal of the container from the frame 32, a top sheet may be fitted over the surface of the material being baled.

Because the stretch plastic wrapping film 41 has "cling" properties whereby the film adheres to itself, the containers so formed are liquid tight. By appropriately forming the bottom of the container when wrapping the film about the support frame 32, the container so formed will be able to be used for flowable material which includes some liquids. Care must be taken, however, that liquids which react with the material of the stretch film are not placed within a container formed in accordance with the present invention.

Figure 9:
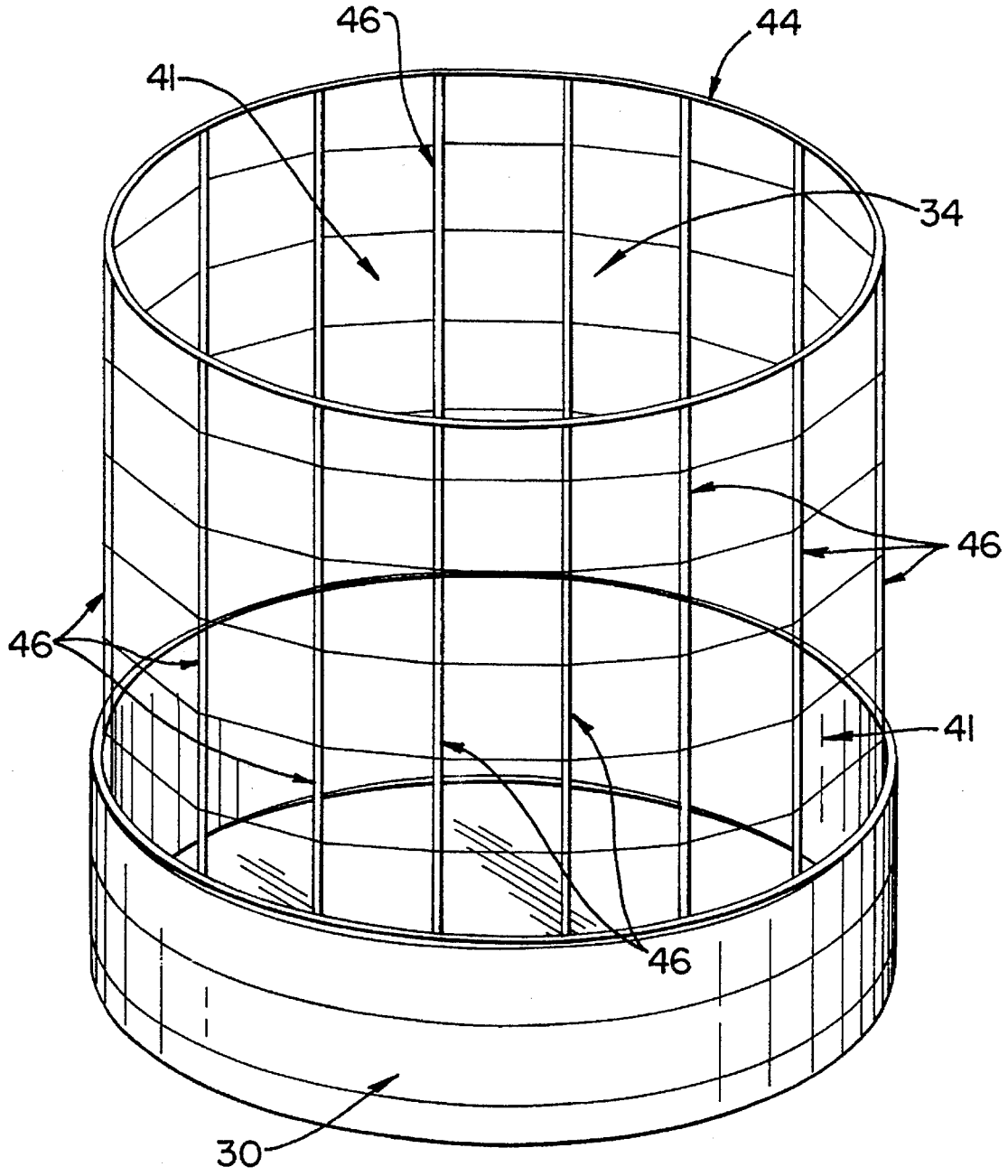
FIG. 9 shows a frame of a second embodiment with stretch plastic film wrapped therearound forming a container.
Figure 11:
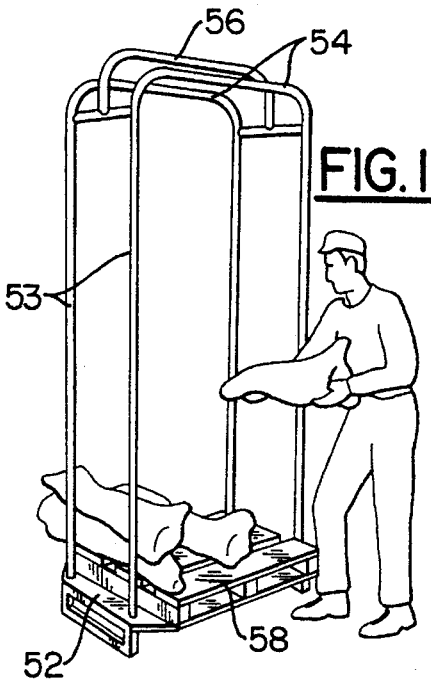
FIG. 11 shows the stacking of carcasses onto a pallet on the frame of FIG. 10.

Referring to FIG. 9, there is illustrated a modified form of support frame 32 in which the open top 34 is defined by a circular frame member 44 having downwardly extending side members 46 which are fixed to the circular frame member 44. When the wrapping film 41 is wrapped about the side members 46, they may flex inwardly, as shown in FIG. 9, and may form a tapering container. The base 30 is formed of impervious material depending on the nature of the flowable or liquid material to be packaged. The base 30 comprises a disc shaped floor portion 30*a* and an upstanding cylindrical flange portion 30*b*. The base 30 should be made of a material which will seal against the wrapped film in use.

Alternatively the support frame 32 and the base 30 may be of any other desired plan view such as a square or rectangular plan view. Such a support frame and base combination would include a square frame member (equivalent to the frame member 44 of FIG. 9) and a suitably configured square base 30. Such a frame may only require downwardly extending members at each corner of the square but may include additional downwardly extending side members disposed along each side of the square frame member. The film is then wrapped around the base and frame assembly. The film may be wrapped several times (up to from 5 to 10 times) circumferentially in overlapping layers around the circumference of the base and partially under the base to ensure that the film is securely attached to the base. The wrapping of the film is then continued spirally up the frame. When the combination is filled to the appropriate level by the desired material the frame may be withdrawn and the film extending above the fill level be drawn together and tied or otherwise sealed to retain the contents in the combination.

It will be appreciated that the present invention may be utilized in many different forms and for many different purposes. Thus, the containers so formed in the performance of the present invention may be used for baling materials such as particulate materials, i.e., fertilizer, or fibrous materials such as wool, or for any other baling purpose. Because of the ease in forming the container using the stretch plastic film wrapped about a support frame, the system of the invention may also be used for household waste disposal and in commercial and office situations for waste disposal purposes. Because the cost of stretch plastic film is substantially less than the cost of commercially available waste disposal bags, the present invention has substantial cost benefits for waste disposal. In addition, the waste material is securely baled in such a way that it is easily handled either manually or by a machine.

Referring to FIG. 10, the first preferred form of temporary physical support means comprises a frame 51 and a base 52. In the preferred form apparatus the frames 1 comprises as shown four legs 53, two on either side, which are joined at the top of the frame by cross-members 54. The bottom end of each leg 53 fits into a hole 55 in the base 52 but is not otherwise fixed to the base, so that the frame may be separated from the base by lifting. Other arrangements for releasably connecting the legs 53 or the equivalent to the base 52 are possible.

A third cross-member 56 is provided at the top of the frame as shown beneath which, for example, the forks of a forklift may be passed to enable the frame to be lifted from the base. The base of the frame has legs 57 on either side enabling the forks of a forklift to pass under the base to lift the base and frame and carcasses stacked thereon.

For packing carcasses in accordance with the method of the invention, a pallet 13 is placed on the base 10 of the frame. A number of carcasses are then stacked on the pallet, as shown. The number of carcasses (and the size of the same) may be as desired for any application and most preferably the carcasses are stacked one carcass deep. This could alternatively be 1½ or 2 carcasses deep using a frame of appropriate dimensions. A one carcass deep pack may typically be approximately 1.2 meters square and 2 meters high and weigh approximately 0.6 tonne for example. In order to fit an optimum number of carcasses of different sizes into the frame, different stacking patterns may be employed. The width of the frame may be adjustable by providing a series of spaced holes 55 in the base 52 at each corner and a sliding connection at the top of each leg 53 to the cross members 54 or equivalent, or by any other suitable arrangement. An adjustable frame allows specific frame width sizes to be set for different grades of carcass so that the same preferred upright head-to-tail stacking patterns can be used for each grade, thereby improving unit shape and reducing unit width, since necks may protrude when carcasses are stowed on their sides.

Figure 12:
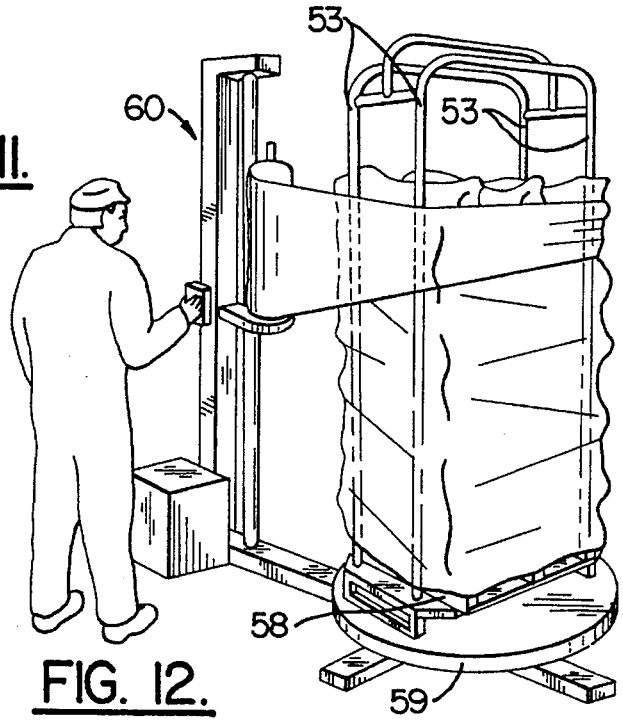
FIG. 12 shows the wrapping of the stack of carcasses contained by the frame of FIG. 10.

Once a stack of carcasses of the desired size within the frame has been formed, the base and frame and stack of carcasses are carried, for example by way of a forklift truck, onto the platten 59 of a spiral wrapping machine 60, and stretch plastic material is wrapped about the stack of carcasses as shown in FIG. 12. Spiral wrapping of a sheet of strip material around the stack of carcasses may be employed as shown, or alternatively the stretch film might be large enough that a single width of material the same height as the stack could be used. In that case the film could be stretched in two dimensions, to further assist in holding the stack.

During wrapping as shown, the material overwraps the legs 53 of the frame 51. The number of layers, the properties of the plastic wrapping material itself, and the tension to which it is wrapped should be such that a self-supporting unit pack of carcasses is formed, with sufficient inherent strength to withstand the rigours of loading, unloading and transport. In trials it has been found that four layers of wrapping preferably with extra layers of wrapping in regions approximately one third and two thirds the height of the stack is very effective and therefore desirable. Suitable wrapping materials include high tensile stretchwrap film, of which 100% linear low density polyethylene (LLDPE) of about 35 microns thickness has been found particularly effective. Typically wrapping may require 25 revolutions of the wrapping machine.

Figure 13:
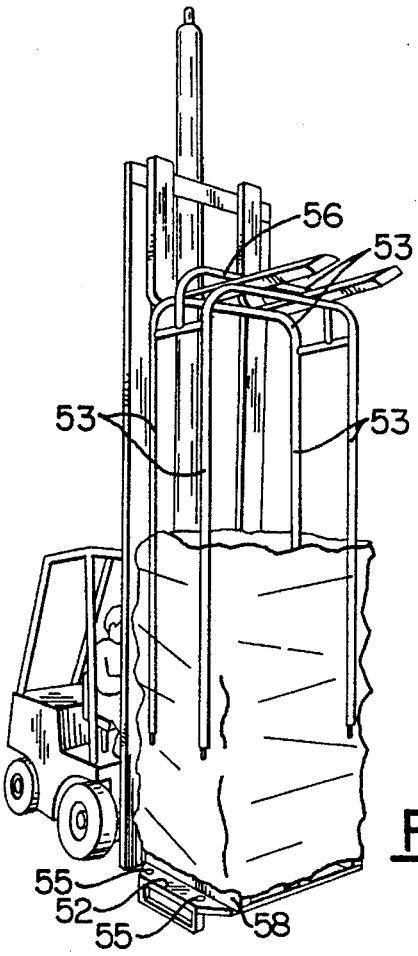
FIG. 13 shows the separation of the frame from the wrapped stack of carcasses.

After wrapping the frame 51 is lifted vertically, so that the legs 53 of the frame slide out from between the stack of carcasses and the wrapping material, as shown in FIG. 13. Despite the adhesive nature of the wrapping material and the tension to which it is wrapped the frame may be withdrawn with reasonable ease. A low friction finish (such as food grade polytetrafluoroethylene PTFE-TEFLON)) may be applied to the legs 53 of the frame to aid frame removal.

In the first preferred form of frame the two legs 53 on either side may be replaced by a single, wide flat leg, or by any other suitable arrangement of one or more legs on any two or even three sides. Also, instead of lifting the frame from out of the pack, the members 54 and 56 or equivalent bridge across the top of the frame might be removable so that the pack may be lifted out of the frame. In another variation the legs of the frame may have a spigot joint that allows a top segment (e.g. half) of the frame to be lifted out after wrapping and the load then lifted from the remaining bottom part. Other arrangements of temporary support means are possible and the preferred forms shown in the drawings are given by way of example. Also, rather than the first preferred form of frame being lifted by a fork lift, in a purpose built plant it is possible that a lifting means above the frame could be provided for lowering and raising the frame.

Figure 14:
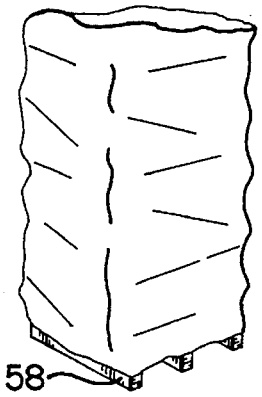
FIG. 14 shows the completed wrapped pack.

A resulting self-supporting pack is shown in FIG. 14. The packs each on 58 may readily be handled, by way of lifting slings or fork lifts trucks for example. The packs may be wrapped and stored at a meat processing plant and the degree of insulation and need for refrigeration will depend on the distance to be travelled in covered trucks. When the packs are delivered alongside a ship they may then be lifted into the ships hold and stowed. The packs' regular unit size allows for efficient utilization of hold space. Because after packing into unitized form, the carcasses are not to be handled individually, handling costs may reduce significantly and loading rates will be increased.

While the pack shown in FIGS. 11 to 14 has one pallet at the base of the pack, a second pallet could if desired be provided at the top of the stack to assist in providing a flat top surface for stacking other packs of carcasses, or to make the pack effectively "reversible" for each of handling. The pallets employed need not necessarily be conventional wooden pallets but could be lightweight disposable pallets, formed of cardboard tubes for example. Ideally the design of the pallet and the base of the frame should be such as to positively locate the pallet on the base.

FIG. 15 shows a second preferred form of frame/temporary physical support means and FIGS. 16 to 18 show the use of this second frame in accordance with the method of the invention. In this arrangement the pack is stacked. horizontally rather than vertically as described with reference to FIGS. 10 to 14. The second preferred form of support means comprises a frame generally indicated at 61 pivotally supported on a bed 60. The frame comprises spaced longitudinal members 62 and uprights 63 at each end thereof. The frame 60 through the longitudinal members 62 and 64 is pivotally connected to the bed 61 as shown.

In use, a bottom pallet 65 and optionally a top pallet 62 are placed on the frame 60 at either end as shown in FIG. 16. A stack of carcasses is formed on the frame between the uprights 63 and pallet(s) and then a number of lengthwise wraps of stretch plastic material are applied as indicated at 67 in FIG. 17. The apparatus is then operated (for example by hydraulic rams or any suitable mechanical arrangement—not shown) to pivot the frame 60 supporting the stack of carcasses in the direction of arrow X in FIG. 17 to the position shown in FIG. 18. The stack of carcasses is then removed from the frame and horizontal wrapping applied about the stack as indicated at 68 to form the finished pack in a similar way as described in relation to FIGS. 10 to 14, for example on a spiral wrapping machine or the like. Also shown in FIGS. 16 to 18 is an alternative form of lightweight disposable pallet, comprising half cardboard tubes with wooden cross members. Other forms of such lightweight disposable pallets could be employed.

Figure 19:
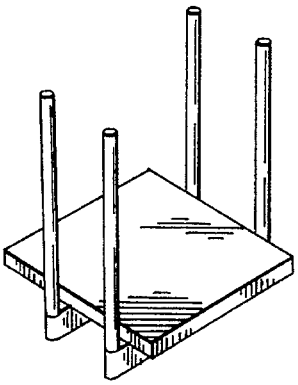
FIGS. 19 to 21 show the wrapping of a stack of carcasses contained by a third preferred form of frame comprising a temporary physical support means, the stack shown being a ½ unit pack which is subsequently joined with another similar ½ unit pack to form a single unit load or pack.
Figure 20:
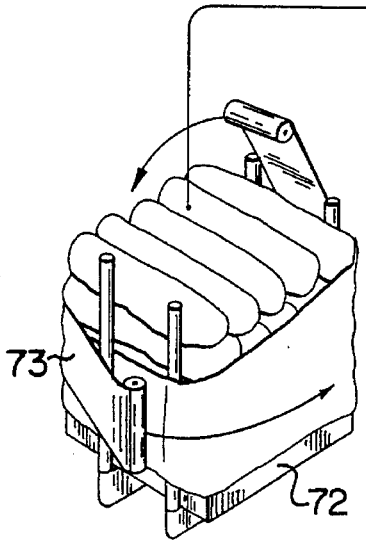
Figure 21:
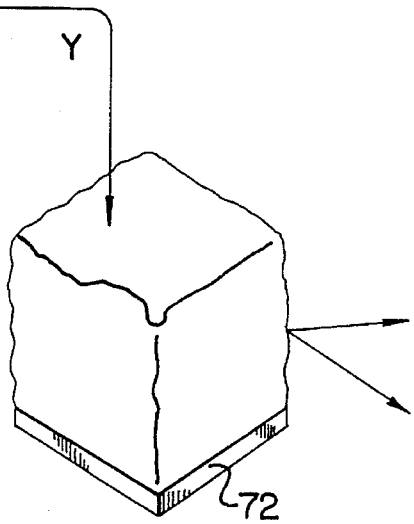

FIGS. 19 to 21 show the wrapping of a stack of carcasses utilizing a third preferred form of frame/physical support means. As shown in FIG. 19, the third form of frame comprises a base 70 and fixed uprights 71. The uprights 31 may be a similar height to the legs 53 of the first preferred form of frame of FIGS. 10 to 14 or, alternatively and as shown in FIGS. 19 to 21, may be a shorter height for forming a half unit pack as will be described.

Figure 22:
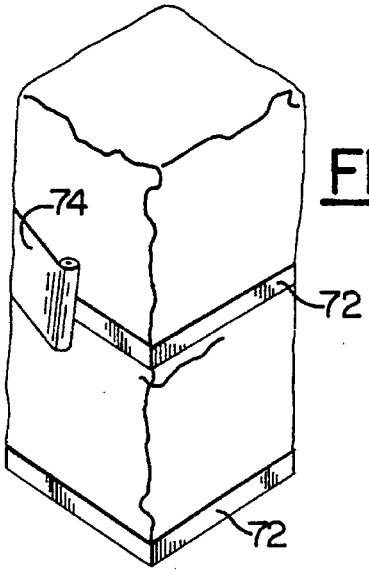
FIG. 22 shows two ½ unit packs each prepared using the frame of FIGS. 19 to 21 joined to form a single unit load or pack.

A suitable pallet 72 is placed on the base of the frame between the uprights 71 and a stack of carcasses is formed on the pallet. The carcass stack is then wrapped as indicated at 73 in FIG. 20, again for example by placing the frame and carcass stack on and using a spiral wrapping machine to form a complete half pack. Again, sufficient wrapping is applied to render the pack self supporting and the pack is then removed as indicated by arrow Y from the frame, for example by lifting with a forklift truck (not shown). Two such half packs may then be stacked one on top of the other as shown in FIG. 22 to form a standard unit pack and further wrapping applied as indicated at 74 to hold the two half packs together. Forming completed packs of two half packs as shown may have advantages at the destination where packs of smaller numbers of carcasses may be more convenient to the end user.

Figure 23:
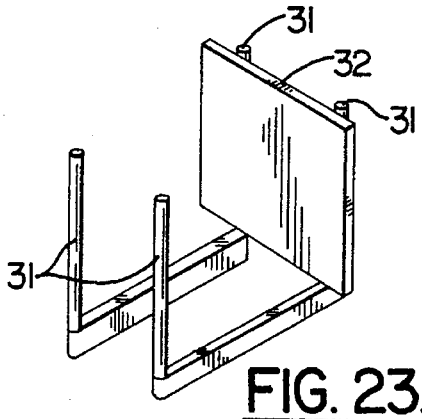
FIGS. 23 to 25 show an alternative way of wrapping of a stack of carcasses contained in the third preferred form of frame of FIGS. 19 to 21 to form a ½ unit pack.
Figure 24:
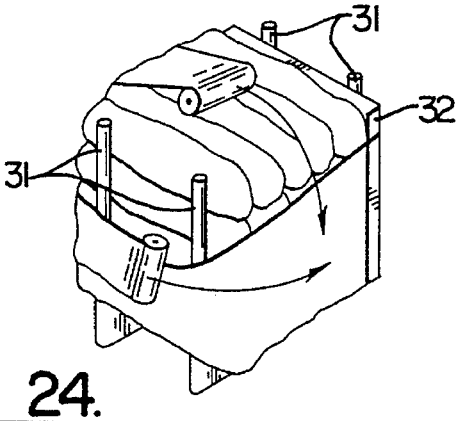
Figure 25:
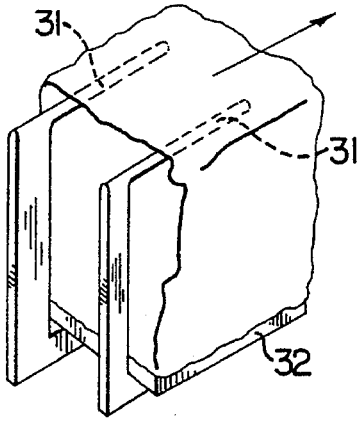

Alternatively the third type preferred form frame comprising fixed uprights with an open top may be utilized as shown in FIGS. 23 to 25, by placing a pallet 72 against the uprights 71 on one side of the frame as shown in FIG. 23, stacking the carcasses in position and wrapping the stack as shown in FIG. 24 in one or both directions, and tipping the frame and separating the frame from the pack as shown in FIG. 25, to form either a half or a whole pack depending on the size of the frame.

In yet a further embodiment of the invention, legs, equivalent to the legs 53 of the first preferred form of frame of FIGS. 10 to 14 or the uprights 71 of the third preferred form of support means of FIGS. 19 to 21 may be telescoping, so that to withdraw the legs from the completed pack they may be caused to telescope downwardly into the base (for example in FIGS. 10 to 14), or upwardly into an overhead platten. Such telescoping legs may suitably be pneumatically or hydraulically operated for example.

When the packs are not in a refrigerated environment, to limit the flow of radiant heat into the load, the emissivity of the wrap may be lowered by co-extruding a highly reflective metalized laminate with the plastic sheet, or including a light-coloured pigment in the plastic composition.

Figure 26:
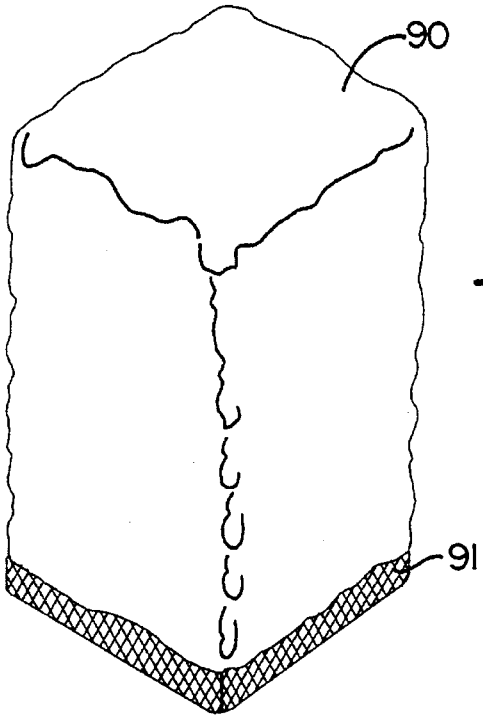
FIGS. 26 to 28 show the application of a bag or areas of protective material to a unit pack or load formed in accordance with the invention.
Figure 27:
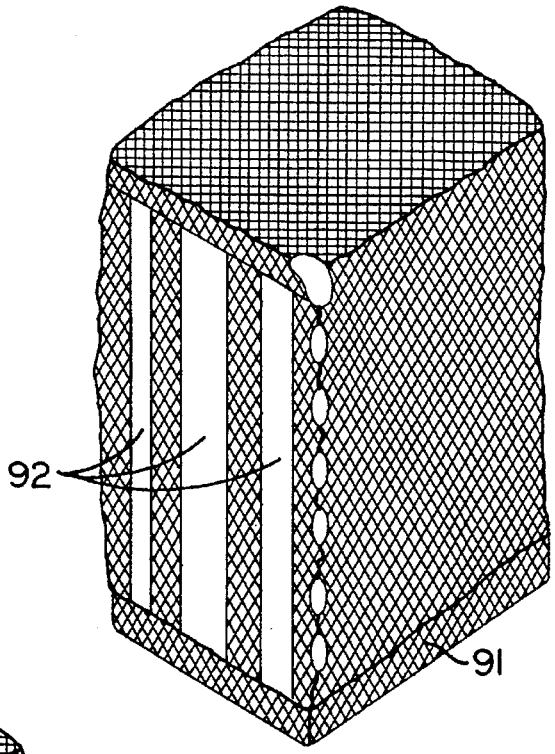
Figure 28:
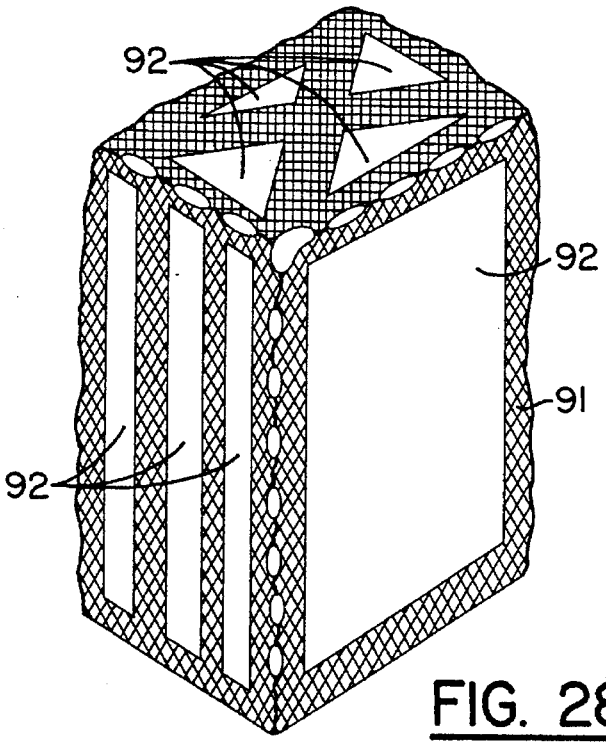

To limit temperature rise from convectional heat flow when the packs are unrefrigerated, and alternatively to further protect the carcasses from physical damage, an envelope of bubble laminate (vacuum formed from plastic film) may be employed, as shown by way of example in FIGS. 26 to 28. In FIG. 26 a bag 90 of bubble laminate has been pulled over the pack 91. The bubble bag 90 could be secured in place by a further wrap of stretch film. Alternatively, the amount of bubble film used may be reduced if adhesive-backed patches 92 are strategically applied to raise points on the sides of the packs and strips used on the corners, as shown in FIGS. 27 and 28. Appropriate pigmentation (e.g. white) of at least the outer layer of the bubble film is advantageous, especially for the top of the unit load.

For maximum effect, the two methods of insulation (i.e. pigment or metallised stretch film and pigmented bubble film) may be used in combination. The additional cost of such wrapping may be offset by savings if either or both of the stockinet and polybag presently used to cover each carcass during handling and shipping are not used.

As another approach, a more elaborate and removable cover may be used to temporarily enshroud and thermally protect unit loads when exposed to the ambient environment, and once the covered packs are aboard ship their covers may be removed and repeatedly returned for reuse.

We claim:

1. A method of forming a wrapped, unitized container for liquid, powder, granular or solid material comprising the steps of:

forming an open frame, locating a base member in said frame, said open frame defining an open space having a volume approximating the volume of said unitized container;

applying stretch plastic wrapping film in stretched condition around said open frame and said base member to form said container open at one end with said open frame in place;

filling said container through said open end at least partially with said material onto said base member;

removing said open frame from said container open at one end after at least said partial filling; and then closing said open end of said container to form a totally closed container in which said plastic wrapping film and said base member alone form said container.

2. The method of forming a wrapped unitized container for liquid, power, granular or solid material according to claim 1 wherein said open frame defines a hollow space wrapped under tension with stretch plastic film forming said container open at one end, said formed container being arranged to be at least partially filled with said material, and wherein after filling of said container said frame is retractable from the volume to allow closing of the container and contents.

3. The method of forming a wrapped unitized container for liquid, powder, granular or solid material according to claim 1 wherein said open frame is adapted to form a rectangular volume in which the frame provides support for the film at the corners of the volume.

4. A method of packaging flowable materials, namely, granules or liquids, comprising the steps of:

bringing an impervious base member and a releasable, open upstanding frame member together; and wrapping under tension said frame member and at least part of said impervious base member with plastic stretch film web and having a filling opening to form an open accessible volume closed at the side and bottom;

filling at least partially the volume with said flowable material; and subsequently removing said releasable frame from said wrapping film after at least partial filling and closing the said filling opening to form a closed package.

5. The method of packaging flowable materials according to claim 4 wherein said open upstanding removable framework defines a hollow space wrapped with stretch plastic film forming said package open at one end, said formed package being arranged to be at least partially filled with said material, wherein after filling of said package, said frame is retractable from the volume to allow closing of the package and contents.

6. The method of packaging flowable materials according to claim 4 wherein said open frame is adapted to form a rectangular volume in which the frame provides support for the film at the corners of the volume.

7. Apparatus for forming a wrapped unitized container for liquid, powder, granular or solid material comprising;

a support;

an open ended frame positioned upon said support adapted to receive a container base and adapted to assist in closing one end of said frame;

a stretch plastic film wrapping means associated with said frame for applying plastic film in stretched condition to said frame to form a container open at one end with the frame in place to allow at least partial filling of the container comprising the stretched plastic film and container base with said material;

removal means for separating said frame from said container comprising the stretched plastic film and container base; and closure means to totally close the container after the frame is separated from said container.

8. A method for forming a wrapped, unitized container for liquid, powder, granules, and solid material, comprising the steps of:

forming an open frame defining an open space having a volume approximating the volume of said unitized container;

applying stretch plastic wrapping film in a stretched condition around said open frame to form said container open at one end with the frame in place with a closed bottom;

filling the container through said open end at least partially with said material;

separating said frame from said wrapping film after at least partially filling; and closing said open end of said container to form a totally closed container in which the plastic wrapping film alone forms said container.

9. The method of forming a wrapped, unitized container for liquid, powder, granular or solid material, according to claim 8 wherein said open frame is adapted to form a rectangular volume in which the frame provides support for the film at the corners of the volume.

10. A method for forming a wrapped, unitized container for liquid, powder, granules, and solid material, comprising the steps of:

forming a non-expandable open frame defining an open space having a volume approximately the volume of said unitized container and said open frame adapted to form a closed bottom;

applying stretch plastic wrapping film in a stretched condition around said open frame to form said container open at one end with the frame in place;

filling the container through said open end at least partially with said material;

separating said frame from said wrapping film after at least partially filling; and closing said open end of said container to form a totally closed container in which the plastic wrapping film alone forms said container.

11. A method for forming a wrapped, unitized container for liquid, powder, granules, and solid material, comprising the steps of:

forming an open frame defining an open space having a volume approximating the volume of said unitized container and said open frame adapted to form a closed bottom;

applying adhesive plastic film under tension around said open frame to form said container open at one end with the frame in place;

filling the container through said open end at least partially with said material;

separating said frame from said film after at least partially filling; and closing said open end of said container to form a totally closed container in which the plastic film alone forms said container.

* * * * *

UNITED STATES PATENT AND TRADEMARK OFFICE
CERTIFICATE OF CORRECTION

PATENT NO. : 5,566,530

DATED : October 22, 1996

INVENTOR(S) : Johnstone, et al.

It is certified that error appears in the above-identified patent and that said Letters Patent is hereby corrected as shown below:

On the title page, item [76], line 4, delete "venue" and insert --Avenue-- therefor.

Title page , item [63] , Related U.S. Appln. Data, line 2, delete "Aug. 8, 1996" and insert --Aug. 8, 1991-- therefor.

Title page , item [56] , U.S. Patent References, line 6, delete "Fulton" and insert --Fulton, Jr.-- therefor.

Title page, item [57], line 6, delete "there around" and insert --therearound-- therefor.

Column 1, line 10, after "articles" insert a comma (,).

Column 1, line 40, after "industrial" insert a comma (,).

Column 1, line 63, delete "comprises" and insert --comprising-- therefor.

Column 2, line 13, delete "releaseable" and insert --releasable-- therefor.

UNITED STATES PATENT AND TRADEMARK OFFICE

CERTIFICATE OF CORRECTION

PATENT NO. : 5,566,530

DATED : October 22, 1996

INVENTOR(S) : Johnstone, et al.

It is certified that error appears in the above-identified patent and that said Letters Patent is hereby corrected as shown below:

Column 2, lines 19 and 54, delete "palletising" and insert --palletizing-- therefor.

Column 3, line 12, delete "In" and insert --in-- therefor.

Column 3, line 46, delete "sketches" and insert --drawings-- therefor.

Column 5, line 10, delete "Whilst" and insert --While-- therefor.

Column 5, line 13, delete "is" and insert --are-- therefor.

Column 5, line 15, delete "requires" and insert --require-- therefor.

Column 5, line 47, delete "this" and insert --This-- therefor.

Column 5, line 59, delete "section" and insert --sections-- therefor.

Column 6, line 14, delete "3" and insert --33-- therefor.

Column 7, line 35, delete "frames 1" and insert --frame 51-- therefor.

UNITED STATES PATENT AND TRADEMARK OFFICE

CERTIFICATE OF CORRECTION

PATENT NO. : 5,566,530

DATED : October 22, 1996

INVENTOR(S) : Johnstone, et al.

It is certified that error appears in the above-indentified patent and that said Letters Patent is hereby corrected as shown below:

Column 7, line 58, delete "tonne" and insert --tons-- therefor.

Column 8, line 7, delete "platten" and insert --platen-- therefor.

Column 8, line 21, delete "rigours" and insert --rigors-- therefor.

Column 8, line 37, before "PTFE" insert a parenthesis --(--.

Column 8, line 52, delete "fork lift" and insert --forklift-- therefor.

Column 8, line 57, after "on" insert --a pallet--.

Column 8, line 58, delete "fork lifts" and insert --forklift-- therefor.

Column 8, line 63, delete "ships" and insert --ship's-- therefor.

Column 9, line 5, delete "each" and insert --ease-- therefor.

Column 9, line 14, after "stacked" omit the period (.).

Column 10, line 14, delete "platten" and insert --platen-- therefor.

UNITED STATES PATENT AND TRADEMARK OFFICE

CERTIFICATE OF CORRECTION

PATENT NO. : 5,566,530

DATED : October 22, 1996

INVENTOR(S) : Johnstone, et al.

It is certified that error appears in the above-identified patent and that said Letters Patent is hereby corrected as shown below:

Column 10, line 19, delete "metalized" and insert --metallized-- therefor.

Column 10, line 20, delete "coloured" and insert --colored-- therefor.

Column 10, line 36, delete "metallised" and insert --metallized-- therefor.

Column 10, line 45, after "returned for reuse" insert the following new paragraph;

--In the drawings and specification, there has been set forth a preferred embodiment of the invention and, although specific terms are employed, the terms are used in a generic and descriptive sense only and not for purpose of limitation, the scope of the invention being set forth in the following claims.--

Column 10, line 67, delete "power" and insert --powder-- therefor.

UNITED STATES PATENT AND TRADEMARK OFFICE

CERTIFICATE OF CORRECTION

PATENT NO. : 5,566,530

DATED : October 22, 1996

INVENTOR(S) : Johnstone, et al.

It is certified that error appears in the above-indentified patent and that said Letters Patent is hereby corrected as shown below:

Column 12, line 55, after "and" begin a new paragraph.

Signed and Sealed this

Tenth Day of June, 1997

*Attest:*

*Attesting Officer*

BRUCE LEHMAN

*Commissioner of Patents and Trademarks*